US005716284A

United States Patent [19]

Maldonado

[11] Patent Number: 5,716,284

[45] Date of Patent: Feb. 10, 1998

[54] BILLIARD/CHECKERS GAME

[76] Inventor: Juan R. Maldonado, 845 Riverside Dr., Apt. 33, New York City, N.Y. 10032

[21] Appl. No.: 770,989

[22] Filed: Dec. 20, 1996

[51] Int. Cl.[6] ..... A63D 15/00; A63D 15/08

[52] U.S. Cl. ..... 473/5; 473/22; 473/45

[58] Field of Search ..... 473/4, 5, 29, 14, 473/18, 22, 45; 273/258

[56] References Cited

U.S. PATENT DOCUMENTS

| | | | |
|---|---|---|---|
| 1,628,446 | 5/1927 | Allinger | 473/22 |
| 3,428,322 | 2/1969 | Motz | 473/18 X |
| 3,455,551 | 7/1969 | Untiedt | 473/22 |
| 3,488,054 | 1/1970 | Brzoska | 473/22 X |
| 4,004,804 | 1/1977 | Gholson | 473/14 |
| 4,036,501 | 7/1977 | Hovnanian | 273/258 |
| 4,171,807 | 10/1979 | Lamlee | 473/18 |
| 5,188,369 | 2/1993 | Loewenton | 273/258 |

*Primary Examiner*—William H. Grieb

[57] ABSTRACT

A pool table including a plurality of numbered balls. Also included is a playing surface with a rectangular configuration having a plurality of divots formed therein. Further provided is a ball collection assembly including a rectilinear periphery integrally formed about the edges of the playing surface with a plurality of vertically oriented bores formed therein. The ball collection assembly further includes at least one cut out formed in a top edge of the periphery. A spring is also included. Finally, at least one pool stick is adapted to utilize the spring for imparting motion to one of the balls.

4 Claims, 3 Drawing Sheets

BILLIARD/CHECKERS GAME

BACKGROUND OF THE INVENTION

1. Field of the Invention

The present invention relates to a pool table and more particularly pertains to providing a game which combines the features of checkers and pool.

2. Description of the Prior Art

The use of pool tables is known in the prior art. More specifically, pool tables heretofore devised and utilized for the purpose of playing billiards are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,036,501 to Hovnanian; U.S. Pat. No. 5,188,369 to Lowewenton; U.S. Pat. No. 4,171,807 to Lamlee; U.S. Pat. No. 3,428,322 to Motz; and U.S. Pat. No. 4,004,804 to Gholson.

In this respect, the pool table according to the present invention substantially departs from the conventional concepts and designs of the prior art, and in so doing provides an apparatus primarily developed for the purpose of providing a game which combines the concepts of checkers and pool.

Therefore, it can be appreciated that there exists a continuing need for a new and improved pool table which can be used for providing a game which combines the concepts of checkers and pool. In this regard, the present invention substantially fulfills this need.

SUMMARY OF THE INVENTION

In view of the foregoing disadvantages inherent in the known types of pool tables now present in the prior art, the present invention provides an improved pool table. As such, the general purpose of the present invention, which will be described subsequently in greater detail, is to provide a new and improved pool table which has all the advantages of the prior art and none of the disadvantages.

To attain this, the present invention essentially comprises a plurality of numbered balls. Further provided is a playing surface with a rectangular configuration having a pair of long edges and a pair of short edges formed therebetween. As shown in FIGS. 1 & 3, the playing surface has a plurality of rows of divots. Each row of divots are offset from an adjacent row, wherein the divots define a multiplicity of triangles. The playing surface further has a breaking groove extending between the short edges thereof along a central extent thereof. Such groove connects a plurality of divots. The playing surface also includes a plurality of semicircular cutouts formed along the edges thereof. For gathering the balls within the divots in the shape of a triangle prior to play, a rack is included having a triangular configuration. Also included is a ball collection assembly including a hollow rectilinear periphery integrally formed about the edges of the playing surface. The ball collection assembly further extends upwardly and downwardly with respect to the playing surface. A channel is formed in the periphery, as shown in FIG. 4. The periphery has a plurality of semicircular cutouts formed contiguously with the cut outs of the playing surface. By this structure, a plurality of vertically oriented circular bores are defined which are in communication with the channel. The periphery further includes a pair of adjacent open faces for accessing the channel and balls during play. The ball collection assembly further has a pair of halved frusto conical cutouts formed in a top edge of the periphery on opposite sides thereof. An axis about which the halved frusto conical cutouts are formed resides in parallel with the groove of the playing surface. Each cut out has a first opening positioned coincident with an outer edge of the periphery and has a first radius. Associated therewith is a second opening positioned coincident with an inner edge of the periphery. The second opening has a second radius less than the first radius. For reasons that will become apparent later, a semicircular groove is formed adjacent the first opening. The ball collection assembly further has a small strip traversing the second opening to form an aperture. Finally, at least one pool stick is included having a butt end, a tip end, a first tapering intermediate portion, and a second cylindrical handle intermediate portion. The second handle intermediate portion has a radius greater than a greatest radius of the first tapering intermediate portion. See FIG. 5. The pool stick further has a first annular flange with a radius equivalent to the first radius. Such flange is concentrically fixed to the first tapering intermediate portion. A second annular flange with a radius equivalent to the second radius is slidably coupled between the first annular flange and an interconnection between the first intermediate portion and the second intermediate portion of the pool stick. Situated about the pool stick between the first annular flange and the second annular flange is a coiled spring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pool table which has all the advantages of the prior art pool tables and none of the disadvantages.

It is another object of the present invention to provide a new and improved pool table which may be easily and efficiently manufactured and marketed.

It is a further object of the present invention to provide a new and improved pool table which is of a durable and reliable construction.

An even further object of the present invention is to provide a new and improved pool table which is susceptible of a low cost of manufacture with regard to both materials and labor, and which accordingly is then susceptible of low prices of sale to the consuming public, thereby making such pool table economically available to the buying public.

Still yet another object of the present invention is to provide a new and improved pool table which provides in the apparatuses and methods of the prior art some of the advantages thereof, while simultaneously overcoming some of the disadvantages normally associated therewith.

Still another object of the present invention is to provide a game which combines the concepts of checkers and pool.

Lastly, it is an object of the present invention to provide a new and improved pool table including a plurality of numbered balls. Also included is a playing surface with a rectangular configuration having a plurality of divots formed therein. Further provided is a ball collection assembly including a rectilinear periphery integrally formed about the edges of the playing surface with a plurality of vertically oriented bores formed therein. The ball collection assembly further includes at least one cut out formed in a top edge of the periphery. A spring is also included. Finally, at least one pool stick is adapted to utilize the spring for imparting motion to one of the balls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
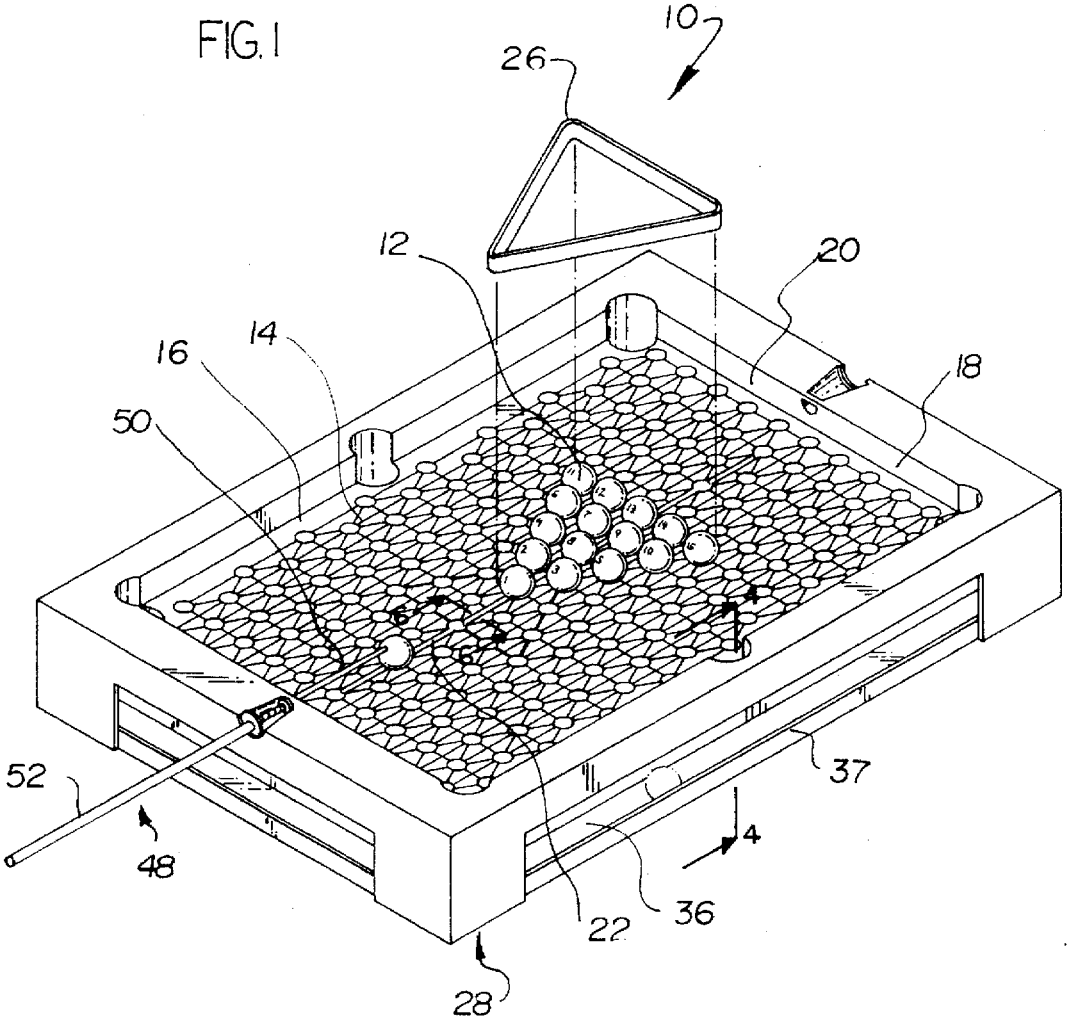
FIG. 1 is a perspective illustration of the preferred embodiment of the pool table constructed in accordance with the principles of the present invention.

With reference now to the drawings, and in particular to FIG. 1 thereof, a new and improved pool table embodying the principles and concepts of the present invention and generally designated by the reference numeral 10 will be described.

The present invention, the new and improved pool table, is comprised of a plurality of components. Such components in their broadest context include a plurality of balls, a playing surface, ball return assembly, and pool sticks. Such components are individually configured and correlated with respect to each other so as to attain the desired objective.

More specifically, it will be noted that the system 10 of the present invention includes a plurality of numbered balls 12. The balls include 7 balls of a first color, 7 balls of a second color, a black ball, and two white cue balls. Ideally, each ball has a diameter of approximately ten-sixteenths to eleven-sixteenths of an inch.

Figure 3:
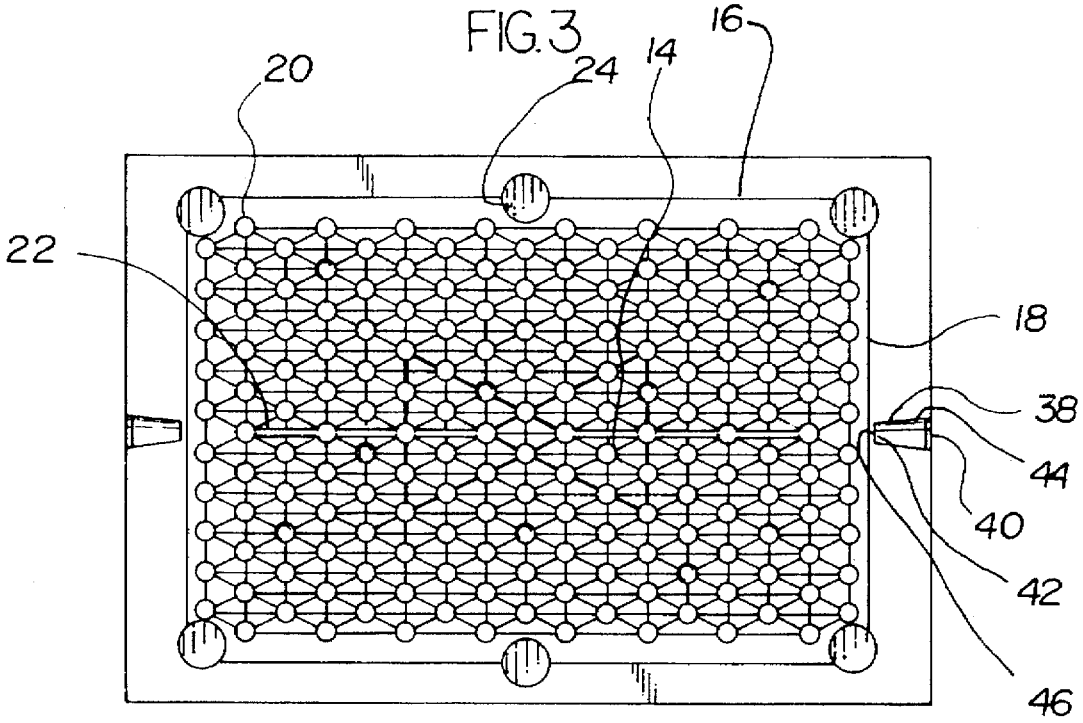
FIG. 3 is a top plan view of the present invention.

Further provided is a playing surface 14 with a rectangular configuration having a pair of long edges 16 and a pair of short edges 18 formed therebetween. As shown in FIGS. 1 & 3, the playing surface has rows of divots 20 which amount to at least 178. Each row of divots are offset from an adjacent row, wherein the divots define a multiplicity of triangles. Ideally, the spacing of the divots is less than twice the diameter of the divots. As shown in FIG. 3, lines are imprinted on the playing surface which interconnect the divots. The playing surface further has a breaking groove 22 extending between the short edges along a central extent thereof. Such groove connects a plurality of divots. The playing surface also includes a plurality of semicircular cutouts 24 formed along the edges thereof. Preferably, the playing surface is 24 inches in length and 14 inches in width.

For gathering the balls within the divots in the shape of a triangle prior to play, a rack 26 is included having a triangular configuration. A pair of triangles are imprinted on the playing surface adjacent a center thereof to facilitate the positioning of the rack.

Figure 4:
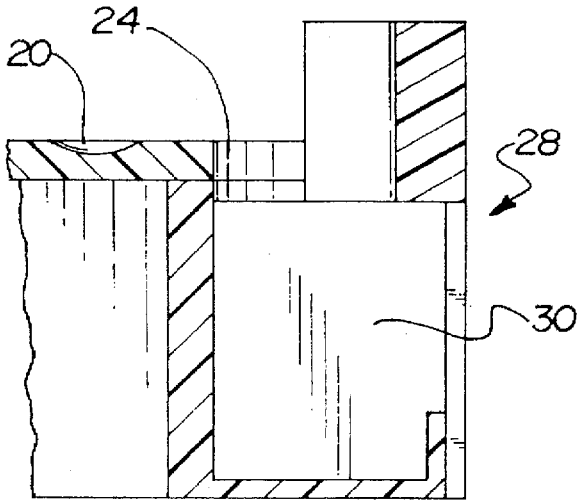
FIG. 4 is a cross-sectional view of the present invention taken along 4—4 shown in FIG. 1.
Figure 6:
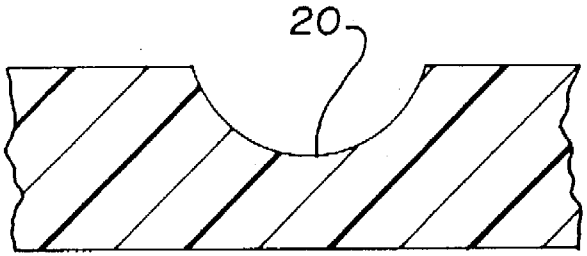
FIG. 6 is a cross-sectional view of the present invention taken along 6—6 shown in FIG. 1.

Also included is a ball collection assembly 28 including a hollow rectilinear periphery integrally formed about the edges of the playing surface. The ball collection assembly further extends upwardly and downwardly with respect to the playing surface. A channel 30 is formed in the periphery, as shown in FIG. 4. The periphery has a plurality of semicircular cutouts 32 formed contiguously with the cut outs of the playing surface. By this structure, a plurality of vertically oriented circular bores 34 are defined which are in communication with the channel. The periphery further includes a pair of adjacent open faces 36 for accessing the channel and balls during play. A pair of lips 37 are utilized to maintain the balls within the channel until removal is desired. As is conventional in the art of pool tables, a lower surface of the channel is bevelled to ensure that the balls roll adjacent the open faces. As shown in FIG. 3, no divots reside on the playing surface within 1 inch of the periphery.

Figure 2:
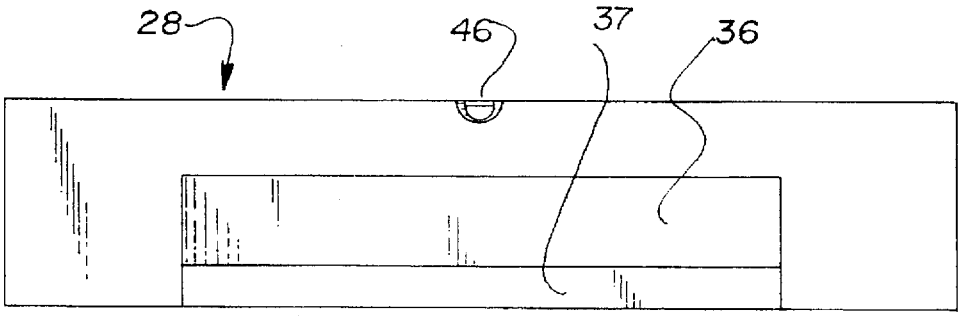
FIG. 2 is a side elevational view of the present invention.

The ball collection assembly further has a pair of halved frusto conical cutouts 38 formed in a top edge of the periphery on opposite sides thereof. An axis about which the halved frusto conical cutouts are formed resides in parallel with the groove of the playing surface. Each cut out has a first opening 40 positioned coincident with an outer edge of the periphery and has a first radius. Associated therewith is a second opening 42 positioned coincident with an inner edge of the periphery. The second opening has a second radius less than the first radius. For reasons that will become apparent later, a semicircular groove 44 is formed adjacent the first opening. The ball collection assembly further has a small strip 46 traversing the second opening to form an aperture. In addition, as shown in FIG. 2, a lip 47 surrounds the entire first opening.

Figure 5:
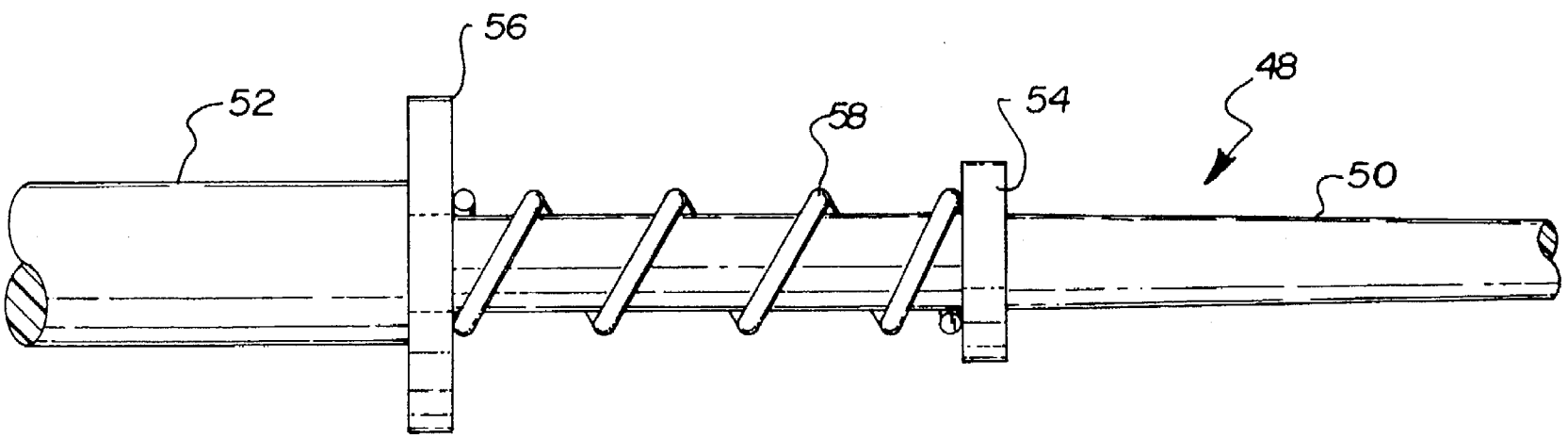
FIG. 5 is a side elevational view of the pool stick of the present invention.

Finally, at least one pool stick 48 is included having a butt end, a tip end, a first tapering intermediate portion 50, and a second cylindrical handle intermediate portion 52. The second handle intermediate portion has a radius greater than a greatest radius of the first tapering intermediate portion. See FIG. 5. The pool stick further has a first annular flange 54 with a radius equivalent to the first radius. Such flange is concentrically fixed to the first tapering intermediate portion. A second annular flange 56 with a radius equivalent to the second radius is slidably coupled between the first annular flange and an interconnection between the first intermediate portion and the second intermediate portion of the pool stick. To constrain the movement of the second annular flange, the bore of the second annular flange has a radius less than the radius of the cylindrical handle intermediate portion of the pool stick. Situated about the pool stick between the first annular flange and the second annular flange is a coiled spring 58.

In use, the first annular flange of one of the pool sticks is situated within one of the halved frusto-conical cut outs against the strip thereof such that the first intermediate portion of the pool stick resides above the playing surface. The second annular flange is positioned within the groove adjacent the first opening such that the second intermediate portion of the pool stick may be pulled rearwardly to bias the spring. Upon the release of the stick, the pool stick imparts motion to one of the balls. Players of the game then take turns using their fingers to impart motion on the balls toward various pockets on the table, in a manner similar to Chinese checkers. Each player is assigned one of the sets of colored balls. The game is won by two different methods. The first player to break the assembled balls and shoot the black ball into a pocket would win the game. In addition, the first player to shoot all balls of his set and the black ball into the table's pockets would win the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved pool table comprising, in combination:

a plurality of numbered balls;

a playing surface with a rectangular configuration having a pair of long edges and a pair of short edges formed therebetween, the playing surface having a plurality of rows of divots, each row of divots being offset from an adjacent row wherein the divots define a multiplicity of triangles, the playing surface further having a breaking groove extending between the short edges thereof along a central extent thereof wherein the groove connects a plurality of divots, the playing surface also having a plurality of semicircular cutouts formed along the edges thereof;

a rack having a triangular configuration for gathering the balls within the divots in the shape of a triangle prior to play;

a ball collection assembly including a hollow rectilinear periphery integrally formed about the edges of the playing surface and further extending upwardly and downwardly therefrom with the periphery having a channel formed therein, the periphery having a plurality of semicircular cutouts formed contiguously with the cut outs of the playing surface to define vertically oriented circular bores which are in communication with the channel, the periphery further including a pair of adjacent open faces for accessing the channel and balls during play, the ball collection assembly further having a pair of halved frusto conical cutouts formed in a top edge of the periphery on opposite sides thereof, an axis about which the halved frusto conical cutouts are formed residing in parallel with the groove of the playing surface, each cut out having a first opening positioned coincident with an outer edge of the periphery and having a first radius, a second opening positioned coincident with an inner edge of the periphery and having a second radius less than the first radius, and a semicircular groove formed adjacent the first opening, the ball collection assembly further having a small strip traversing the second opening to form an aperture; and at least one pool stick having a butt end, a tip end, a first tapering intermediate portion, and a second cylindrical handle intermediate portion with a radius greater than a greatest radius of the first tapering intermediate portion, the pool stick having a first annular flange with a radius equivalent to the first radius concentrically fixed to the first tapering intermediate portion, a second annular flange with a radius equivalent to the second radius coupled between the first annular flange and an interconnection between the first intermediate portion and the second intermediate portion of the pool stick, and a coiled spring concentrically situated about the pool stick between the first annular flange and the second annular flange;

whereby the first annular flange of one of the pool sticks is situated within one of the halved frusto-conical cut outs against the strip thereof such that the first intermediate portion of the pool stick resides above the playing surface, the second annular flange is positioned within the groove adjacent the first opening such that the second intermediate portion of the pool stick may be pulled to bias the spring thereby allowing one of the balls to be projected upon the release thereof.

2. A pool table comprising:

a plurality of numbered balls;

a playing surface with a rectangular configuration;

a ball collection assembly including a rectilinear periphery integrally formed about the edges of the playing surface with a plurality of vertically oriented bores formed therein;

a spring means;

at least one pool stick having a butt end and a tip end, the pool stick adapted to utilize the spring means for imparting motion to one of the balls; and a halved frusto conical cutout formed in a top edge of the all collection assembly, each cut out having a first opening positioned coincident with an outer edge of the periphery and having a first radius, a second opening positioned coincident with an inner edge of the periphery and having a second radius less than the first radius, and a semicircular groove formed adjacent the first opening, the ball collection assembly further having a small strip traversing the second opening to form an aperture.

3. A pool table as set forth in claim 2 wherein the pool stick has a first tapering intermediate portion and a second cylindrical handle intermediate portion with a radius greater than a greatest radius of the first tapering intermediate portion, the pool stick having a first annular flange with a radius equivalent to the first radius concentrically fixed to the first tapering intermediate portion, a second annular flange with a radius equivalent to the second radius coupled between the first annular flange and an interconnection between the first intermediate portion and the second intermediate portion of the pool stick, and a coiled spring concentrically situated about the pool stick between the first annular flange and the second annular flange.

4. A pool table comprising:

a plurality of numbered balls;

a playing surface with a rectangular configuration, the playing surface having a plurality of divots formed therein, wherein the playing surface has a plurality of rows of divots, each row of divots being offset from an adjacent row wherein the divots define a multiplicity of triangles;

a ball collection assembly including a rectilinear periphery integrally formed about the edges of the playing surface with a plurality of vertically oriented bores formed therein; and at least one pool stick having a butt end and a tip end;

wherein the playing surface has a breaking groove extending between the short edges thereof along a central extent thereof wherein the groove connects a plurality of divots.

* * * * *